US010955205B2

(12) United States Patent
Bitz et al.

(10) Patent No.: US 10,955,205 B2
(45) Date of Patent: Mar. 23, 2021

(54) BEDDING BLOCK

(71) Applicants: Donald F. Bitz, West Palm Beach, FL (US); Thomas O. Pierce, Rochester, NY (US)

(72) Inventors: Donald F. Bitz, West Palm Beach, FL (US); Thomas O. Pierce, Rochester, NY (US)

(73) Assignee: Donald F. Bitz, West Palm Beach, FL (US)

( * ) Notice: Subject to any disclaimer, the term of this patent is extended or adjusted under 35 U.S.C. 154(b) by 28 days.

(21) Appl. No.: 16/289,208

(22) Filed: Feb. 28, 2019

(65) Prior Publication Data

US 2020/0278162 A1 Sep. 3, 2020

(51) Int. Cl.
*F41A 3/66* (2006.01)

(52) U.S. Cl.
CPC ..... *F41A 3/66* (2013.01)

(58) Field of Classification Search
CPC ..... F41A 11/02; F41A 3/64; F41A 3/66
USPC ..... 42/75.01, 75.03
See application file for complete search history.

(56) References Cited

U.S. PATENT DOCUMENTS

| | | | | |
|---|---|---|---|---|
| 6,487,805 | B1 * | 12/2002 | Reynolds | F41A 21/485 42/75.03 |
| 7,726,060 | B1 * | 6/2010 | Jones | F41A 3/66 42/75.02 |
| 9,625,224 | B2 * | 4/2017 | Olsen | F41A 3/66 |
| 9,631,885 | B2 * | 4/2017 | Jones | F41A 11/02 |
| 10,539,387 | B1 * | 1/2020 | Joplin | F41A 21/487 |
| 2005/0115135 | A1 * | 6/2005 | Thompson | F41A 21/485 42/75.02 |
| 2005/0235545 | A1 * | 10/2005 | Roller | F41C 23/18 42/75.1 |
| 2009/0277067 | A1 * | 11/2009 | Gregg | F41A 3/66 42/69.01 |
| 2010/0162605 | A1 * | 7/2010 | Laney | F41A 15/14 42/25 |
| 2012/0180360 | A1 * | 7/2012 | Jones | F41A 3/66 42/75.03 |
| 2016/0187087 | A1 * | 6/2016 | Olsen | F41A 3/66 42/75.03 |
| 2017/0314890 | A1 * | 11/2017 | Ludlow | F41A 21/48 |

* cited by examiner

*Primary Examiner* — Jonathan C Weber
(74) *Attorney, Agent, or Firm* — Ziegler IP Law Group, LLC

(57) ABSTRACT

A bedding block for securing a receiver frame includes a front recoil lug receptacle having a forward cam surface with laterally extending stepped ribs and a rearward bearing surface, and a rear recoil lug receptacle having a truncated ovoid bore.

8 Claims, 10 Drawing Sheets

BEDDING BLOCK

BACKGROUND

Field

The aspects of the present disclosure relate generally to firearms, and in particular to a firearm bedding block.

Description of Related Art

A firearm, for example a rifle, generally includes a stock, an action, and a barrel. The action typically includes a receiver, connected to the barrel, that houses a firing mechanism, and the receiver and barrel are typically mounted on the stock. A cartridge is inserted into the receiver and fired, and the bullet from the cartridge exits through the barrel. While the firearm components are generally rigidly fastened to each other, when the firearm is fired, the components are subject to considerable horizontal, vertical, longitudinal, and torsional forces which may result in position changes among the components. In addition, disassembling and reassembling the firearm may also result in position changes among the components. Whether as a result of firing forces or disassembly and reassembly, such position changes may have a negative effect on accuracy.

In some instances, a bedding block may be provided between the receiver barrel combination and the stock to provide a mounting platform for the receiver and barrel however, while present bedding blocks may reduce the amount of positional changes with respect to the components, they may still permit an unacceptable amount of movement that may compromise shooting accuracy. It would be advantageous to provide a bedding block that provides sufficient horizontal, vertical, longitudinal, and torsional rigidity and minimizes relative movement among the receiver, barrel and stock.

SUMMARY

As described herein, the exemplary embodiments overcome one or more of the above or other disadvantages known in the art.

The disclosed embodiments are directed to a bedding block for securing a receiver frame, including a front recoil lug receptacle having a forward cam surface with laterally extending stepped ribs and a rearward bearing surface, and a rear recoil lug receptacle having a truncated ovoid bore.

The laterally extending stepped ribs may be arranged to contact a forward facing cam surface of a recoil lug and force a rearward facing surface of the recoil lug into bearing contact with the rearward bearing surface of the front recoil lug receptacle.

The laterally extending stepped ribs may include center portions and distal ends extending rearward from the center portions.

The bedding block may include longitudinally extending sides within which the center portions of the laterally extending stepped ribs are centered The laterally extending stepped ribs may be arranged to force a recoil lug inserted into the front recoil lug receptacle toward the center portions of the of the laterally extending stepped ribs, centering the recoil lug between the longitudinally extending sides.

The rear recoil lug receptacle may further include a narrowing chamfer to which the truncated ovoid bore vertically extends.

The bedding block may further include longitudinally extending sides within which the rear recoil lug receptacle is centered.

The narrowing chamfer may be arranged to force a recoil lug inserted into the rear recoil lug receptacle to be centered in the truncated ovoid bore, centering the recoil lug between the longitudinally extending sides.

DETAILED DESCRIPTION OF THE DISCLOSED EMBODIMENTS

For purposes of the disclosed embodiments, the term longitudinal refers to a direction along the length of the firearm, the terms horizontal and vertical refer to horizontal and vertical directions with respect to gravity pulling vertically down, the term torsional refers to a rotation around the longitudinal direction, the term forward generally refers to a direction toward a muzzle end, the term rearward generally refers to a direction toward a buttstock end, and the terms forward facing and rearward facing refer to facing, from a midpoint of the firearm, the muzzle end and the buttstock end, respectively.

Figure 1:
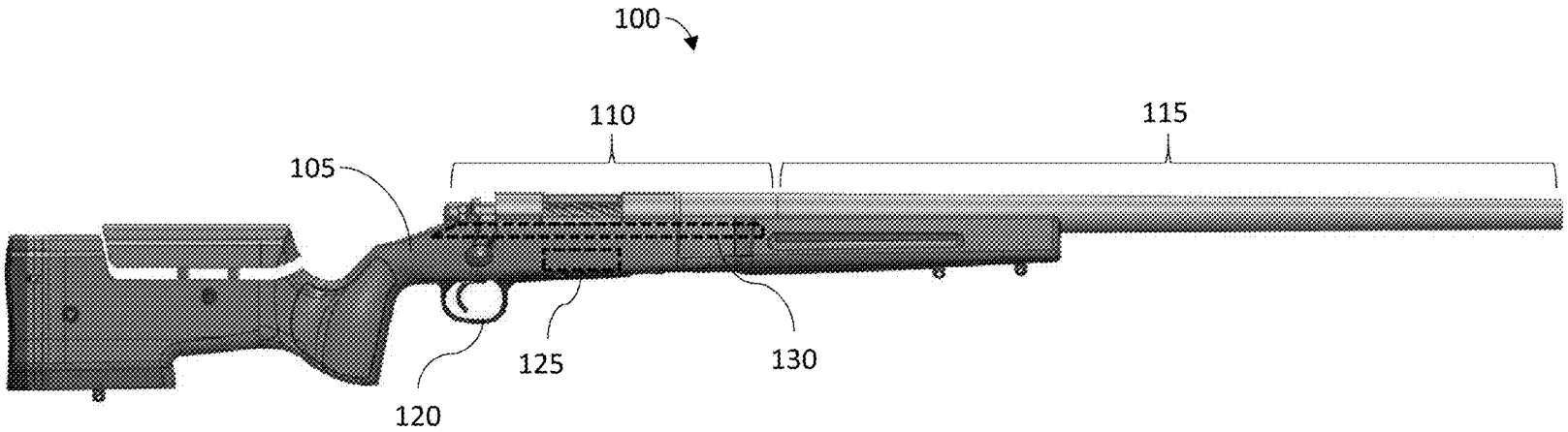
FIG. 1 illustrates an exemplary firearm assembly according to the disclosed embodiments.

FIG. 1 illustrates an exemplary firearm assembly 100 according to the disclosed embodiments. In this example, the firearm assembly 100 may include a stock 105, an action 110, and a barrel 115. The firearm assembly 100 may also include a trigger mechanism 120, and a magazine 125 and bedding block 130, interior to the stock 105 in this embodiment. While the disclosed embodiments are described using a rifle as an example, it should be understood that the disclosed embodiments may be utilized in any firearm that may benefit from the inventive concepts described herein.

Figure 2:
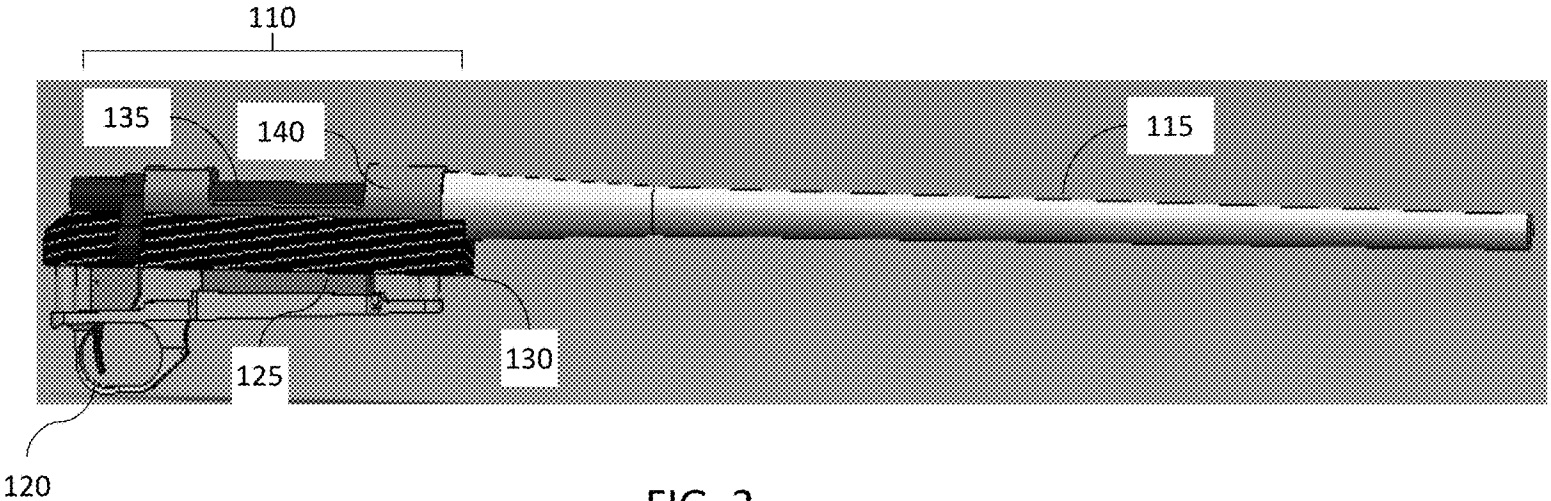
FIG. 2 illustrates a schematic diagram of certain components of the firearm assembly without showing a stock.

FIG. 2 illustrates a schematic diagram of certain components of the firearm assembly 100 without showing the stock 105. In this embodiment, the action 110 may include a bolt 135 and a receiver 140 which, along with the barrel 115, may be mounted to a top side of the bedding block 130. The trigger mechanism 120 and the magazine 125 may be mounted to a bottom side of the bedding block 130. The bedding block 130 may be integral to, mounted to, embedded in, or otherwise fastened to the stock 105.

Figure 3A:
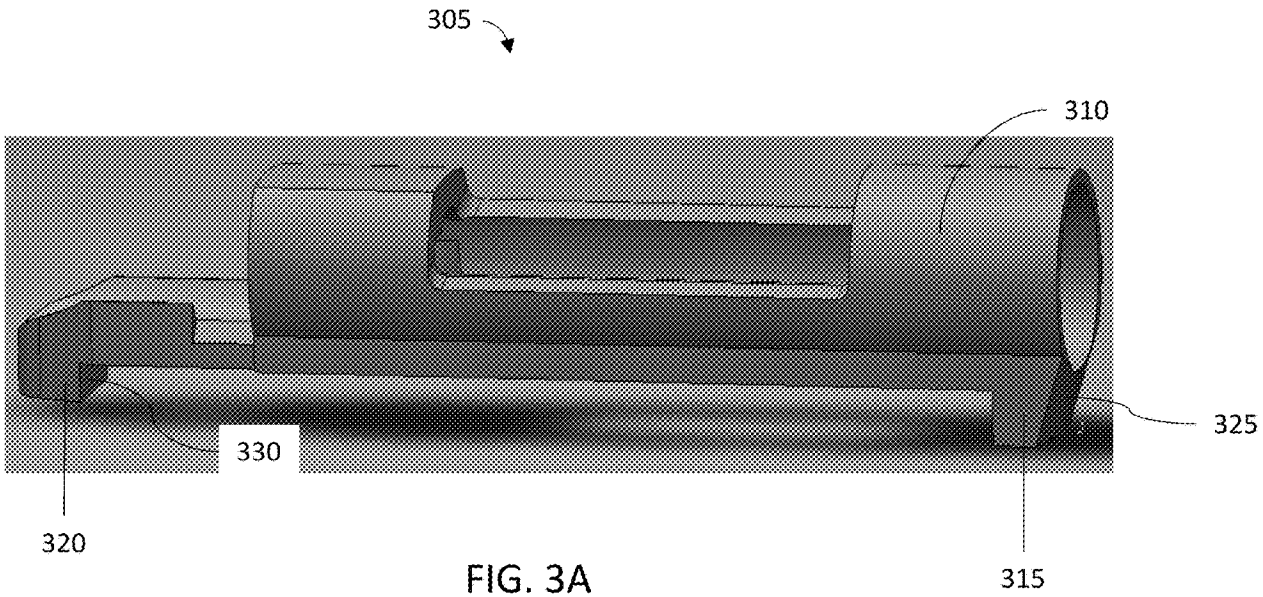
FIGS. 3A and 3B illustrate perspective views of a receiver frame according to the disclosed embodiments.
Figure 3B:
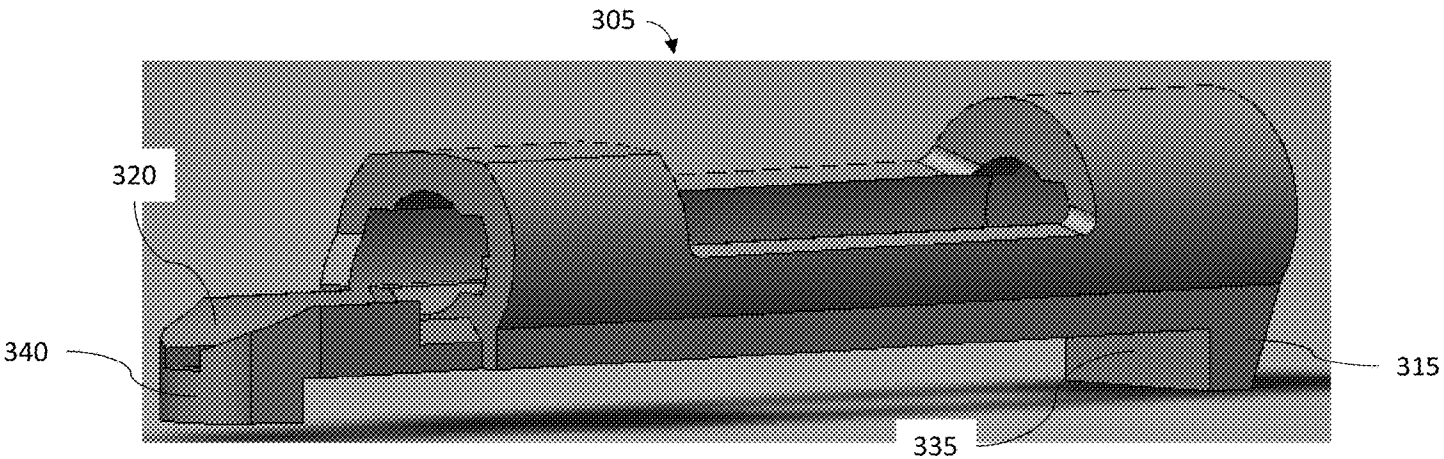

FIGS. 3A and 3B illustrate perspective views of a stripped receiver, also referred to as a receiver frame 305. In one or more embodiments, the receiver frame may be constructed of a relatively rigid material compared to the material used for the bedding block 130, for example, steel. The receiver frame 305 may include a housing 310, a front recoil lug 315 and a rear recoil lug 320. The housing may enclose the bolt 135 and a firing mechanism (not shown), operated by the trigger mechanism 120. As shown in FIG. 3A, the front recoil lug 315 may have a frusto-pyramidal or cuboid shape and may have a forward facing cam surface 325. The rear recoil lug 320 may have a rearward facing truncated ovoid or cylindrical shape 340 with a forward facing rectangular surface 330. As shown in FIG. 3B, the front recoil lug 315 may have a rearward facing rectangular surface 335 and the rear recoil lug 320 may have a rearward forward facing ovoid or cylindrical surface 340.

Figure 3C:
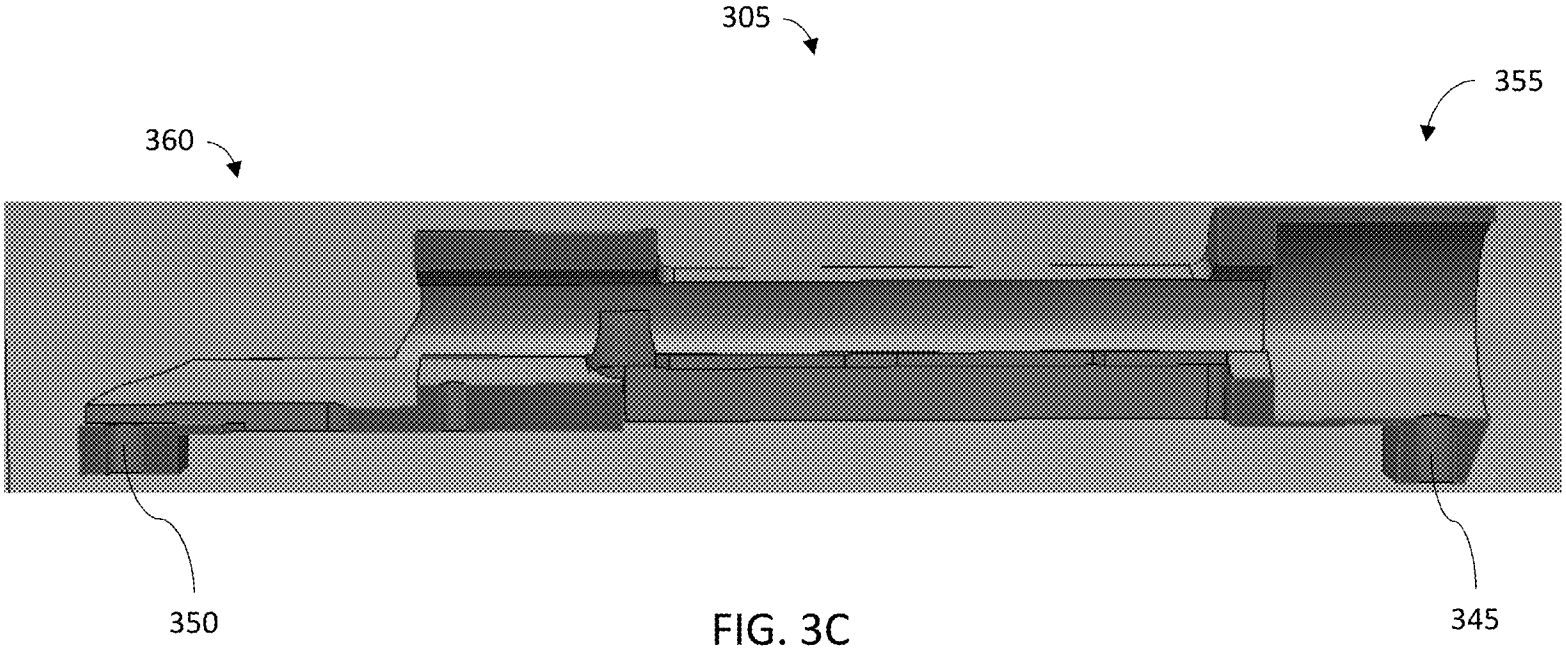
FIG. 3C shows a cross sectional view of the receiver frame.

FIG. 3C shows a cross sectional view of receiver frame 305. Receiver frame 305 may include at least one mounting hole 345 in a forward portion 355 of the receiver frame 305 in the front recoil lug 315, and at least one mounting hole 350 in a rearward portion 360 of the receiver frame 305, in the rear recoil lug 320. The mounting holes 345, 350 may be threaded or may have any suitable configuration for accepting fasteners for rigidly attaching the receiver frame 305 to the bedding block 130.

Figure 4:
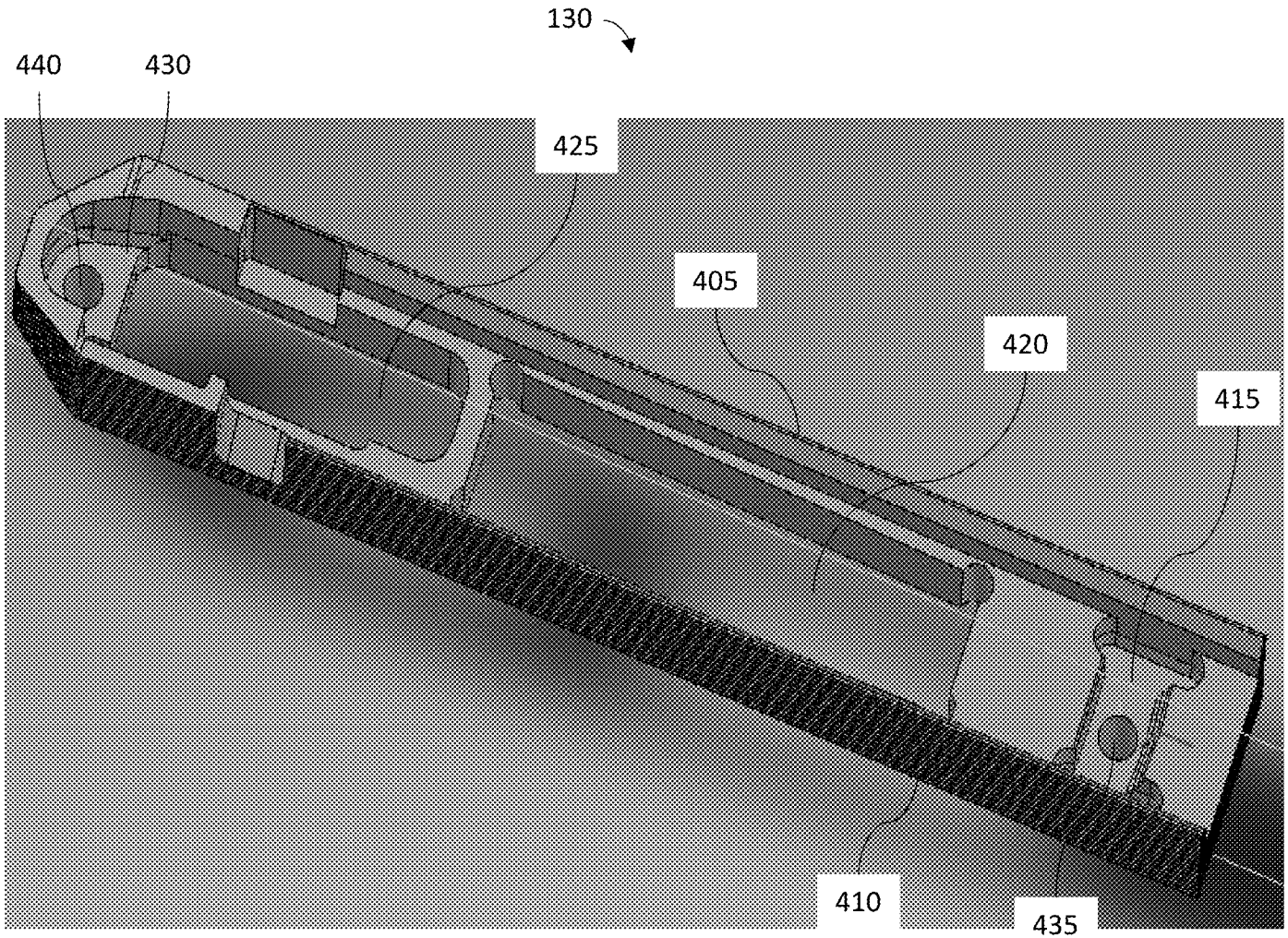
FIG. 4 shows a perspective view of a bedding block according to the disclosed embodiments.

FIG. 4 shows a perspective view of the bedding block 130 according to the disclosed embodiments. The exemplary bedding block 130 may be constructed of a material, for example, aluminum, that may be slightly deformable compared to the material of the receiver frame 305. The bedding block 130 may have a longitudinally extending cuboid shape with vertical, longitudinally extending sides 405, 410, a front recoil lug receptacle 415, a magazine aperture 420, a trigger mechanism aperture 425, and a rear recoil lug receptacle 430. The bedding block 130 may also include an opening 435 in the front recoil lug receptacle 415, corresponding to the mounting hole 345 in the front recoil lug 315, and an opening 440 in the rear recoil lug receptacle 430, corresponding to the mounting hole 350 in the rear recoil lug 320. The openings 435, 440 may provide passages for fasteners for rigidly attaching the receiver frame 305 to the bedding block 130. In some embodiments, the fasteners may mount the trigger mechanism 120 and the magazine 125 to a bottom side of the bedding block 130, by passing through the bedding block 130, and being captured in the mounting holes 345, 350 of the receiver frame 140.

The front recoil lug receptacle 415 may have a generally cuboid shape with cylindrical relief cut outs at the corners. The rear recoil lug receptacle 430 may have a generally truncated cylindrical or ovoid shape with a surrounding chamfer extending from the sides to a bottom portion of the bedding block 130.

Figure 5A:
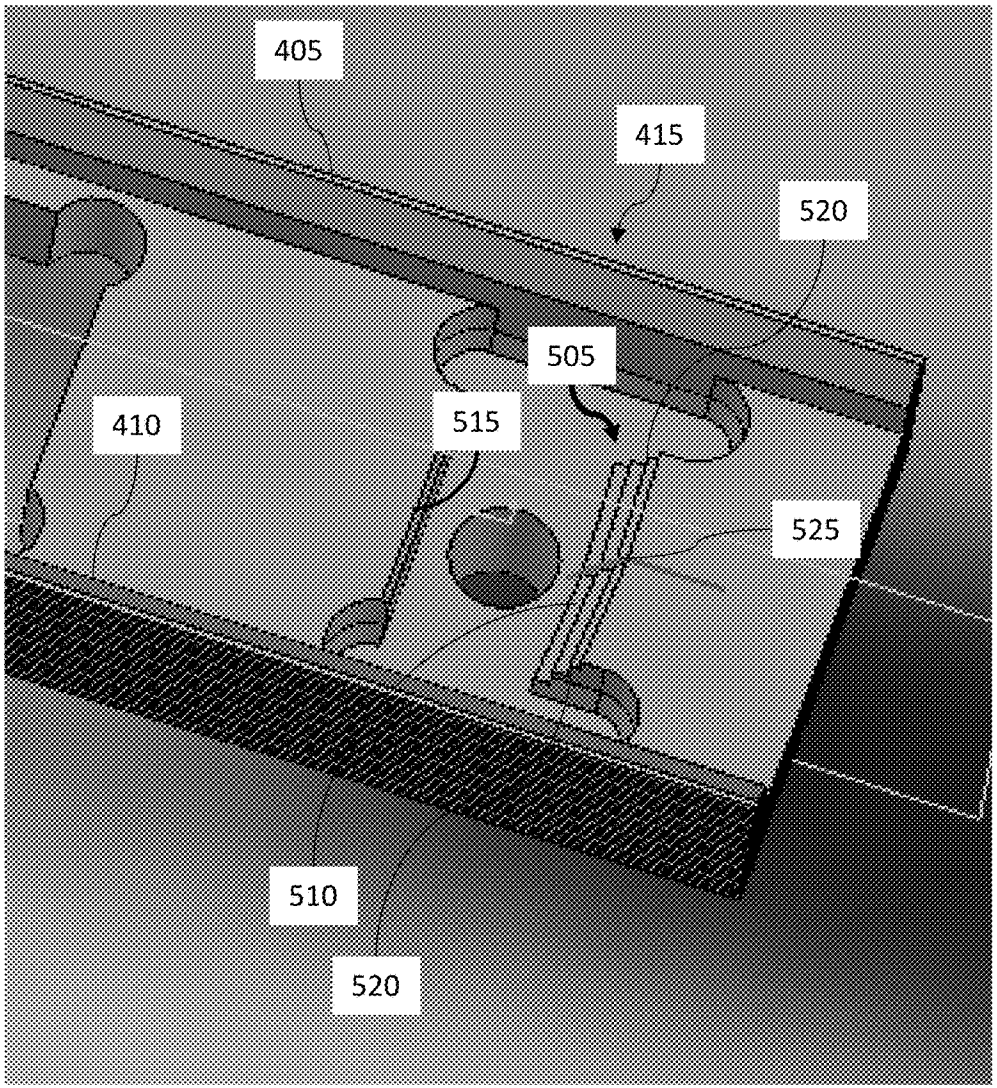
FIG. 5A shows an expanded view of a front recoil lug receptacle of the bedding block.

FIG. 5A shows an expanded view of the front recoil lug receptacle 415. The front recoil lug receptacle 415 may narrow toward the bottom of the receptacle and may have a forward cam surface 505 with laterally extending stepped ribs 510 with bottom ribs extending further into the receptacle than upper ribs, and a vertical, substantially flat, rearward bearing surface 515. The laterally extending stepped ribs 510 may have a V-shape, or may be curved, such that distal ends 520 of the stepped ribs 510 extend rearward with respect to a center portion 525. The center portion 525 of the stepped ribs 520 may be centered between the vertical, longitudinally extending sides 405, 410 of the bedding block 130.

Figure 5B:
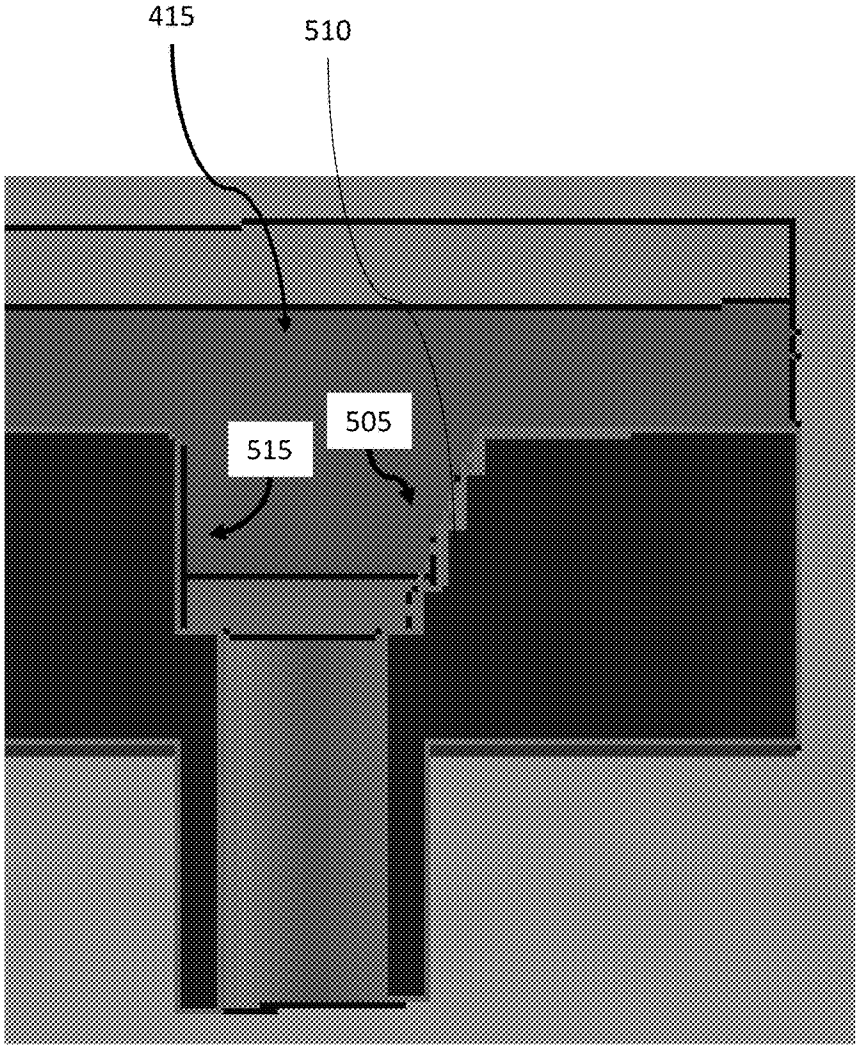
FIG. 5B shows a cross sectional view of the front recoil lug receptacle.

FIG. 5B shows a cross sectional view of the front recoil lug receptacle 415, further illustrating the forward cam surface 505 with the laterally extending stepped ribs 510 and the vertical, substantially flat, rearward bearing surface 515.

Figure 5C:
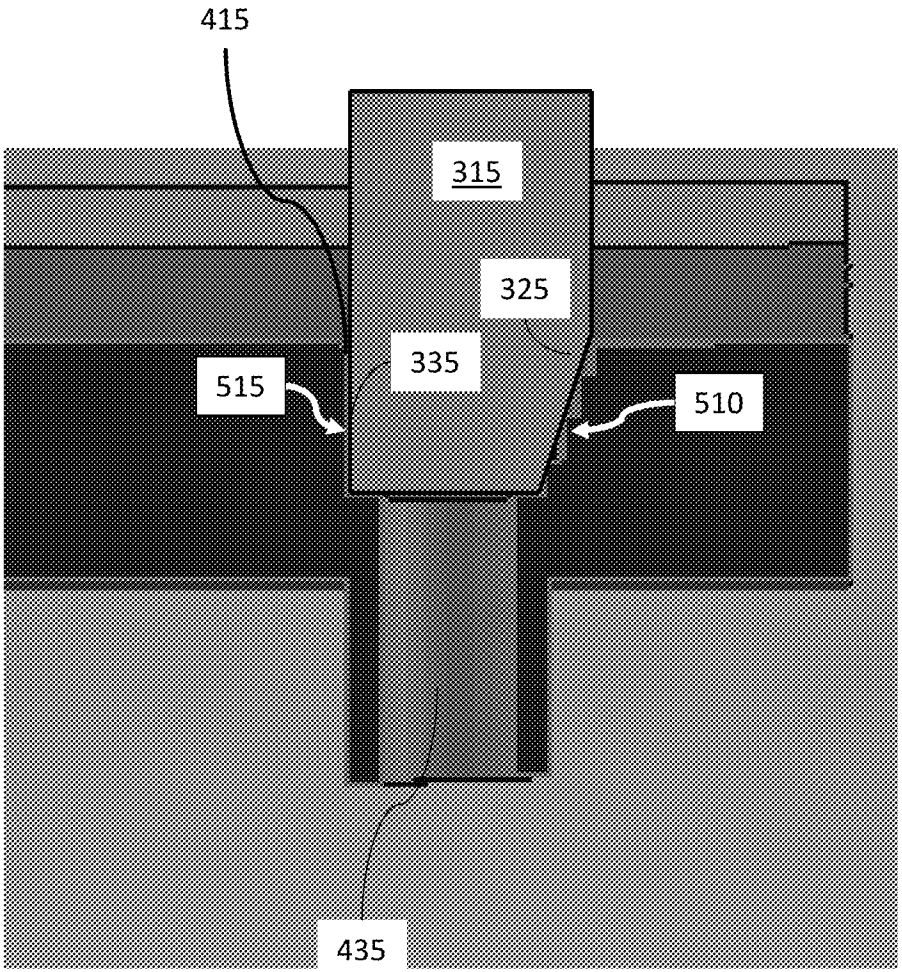
FIG. 5C shows a schematic diagram of a front recoil lug inserted in the front recoil lug receptacle.

FIG. 5C shows a cross sectional diagram illustrating the front recoil lug 315 inserted in the front recoil lug receptacle 415. In some embodiments, the front recoil lug 315 may be drawn into the front recoil lug receptacle 415 by a fastener inserted into through hole 435. As the front recoil lug 315 is inserted into the front recoil lug receptacle 415, the forward front recoil lug forward facing cam surface 325 slidingly contacts the laterally extending stepped ribs 510, preventing vertical motion of the forward front recoil lug 315 and forcing the rearward facing rectangular surface 335 into bearing contact with rearward bearing surface 515. The curved or V-shape of the laterally extending stepped ribs 510 may force the front recoil lug toward the center portion 525 of the of the laterally extending stepped ribs 510, thus centering at least the forward portion 355 of the receiver frame 305 in the bedding block 130 between the longitudinally extending sides 405, 410.

The front recoil lug 315 may be drawn tightly into the front recoil lug receptacle 415 such that the laterally extending stepped ribs 510 may form an interference fit with the forward facing cam surface 325 and may provide a rearward force on the receiver frame 305, forcing the rear recoil lug 320 into the rear recoil lug receptacle 430. The front recoil lug 315 may also be drawn tightly into the front recoil lug receptacle 415 such that contact between a bottom surface of the front recoil lug 315 and a bottom surface of the front recoil lug receptacle 415 provides vertical, horizontal, and torsional rigidity, while the fit between the laterally extending stepped ribs 510 and front recoil lug forward facing cam surface 325, and the resulting fit between the rearward bearing surface 515 and the front recoil lug rearward facing rectangular surface 335 provides longitudinal rigidity.

Figure 6A:
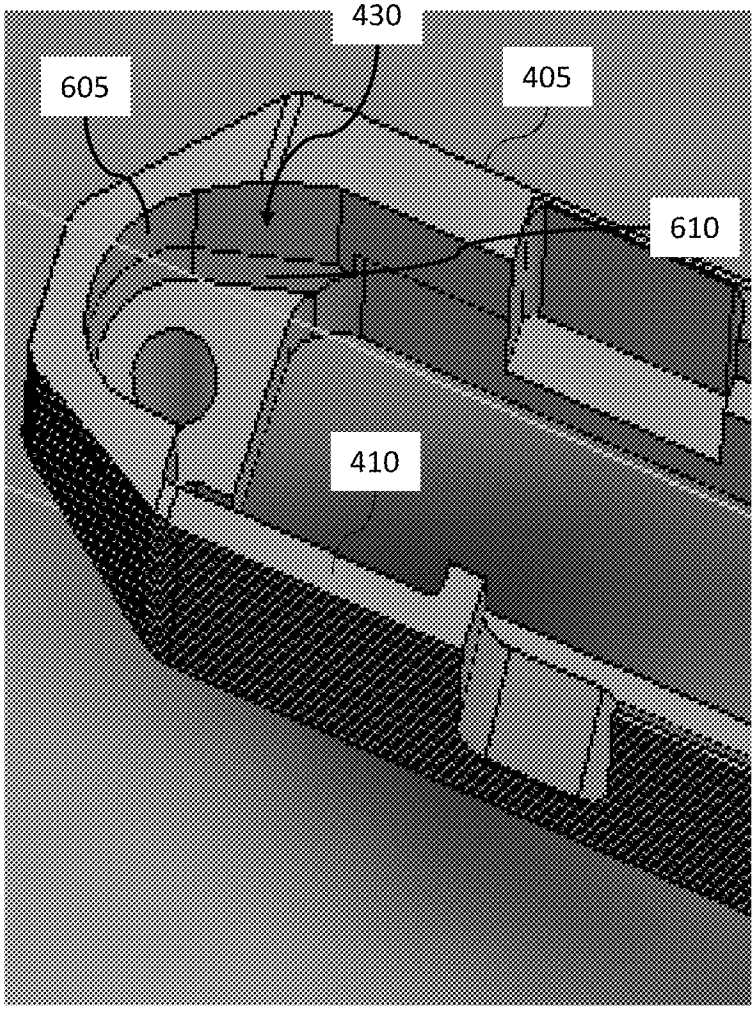
FIG. 6A shows an expanded view of a rear recoil lug receptacle of the bedding block.

FIG. 6A shows an expanded view of the rear recoil lug receptacle 430. The rear recoil lug receptacle 430 may have a truncated cylindrical or ovoid bore 605 extending vertically downward to a narrowing chamfer 610. The bore 605 may be centered between the vertical, longitudinally extending sides 405, 410 of the bedding block 130.

Figure 6B:
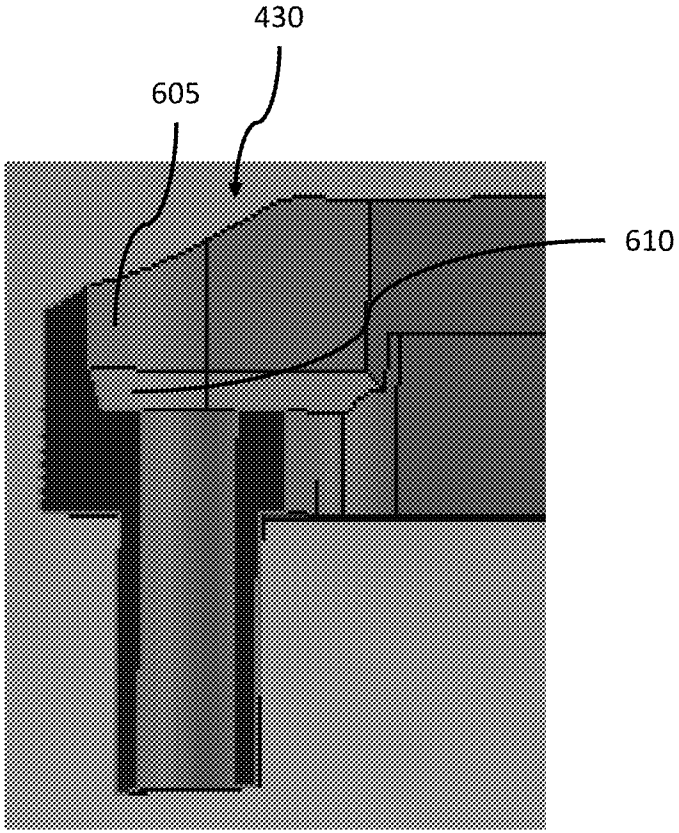
FIG. 6B shows a cross sectional view of a rear recoil lug receptacle of the bedding block.

FIG. 6B shows a cross sectional view of the rear recoil lug receptacle 430 further illustrating the bore 605 and chamfer 610.

Figure 6C:
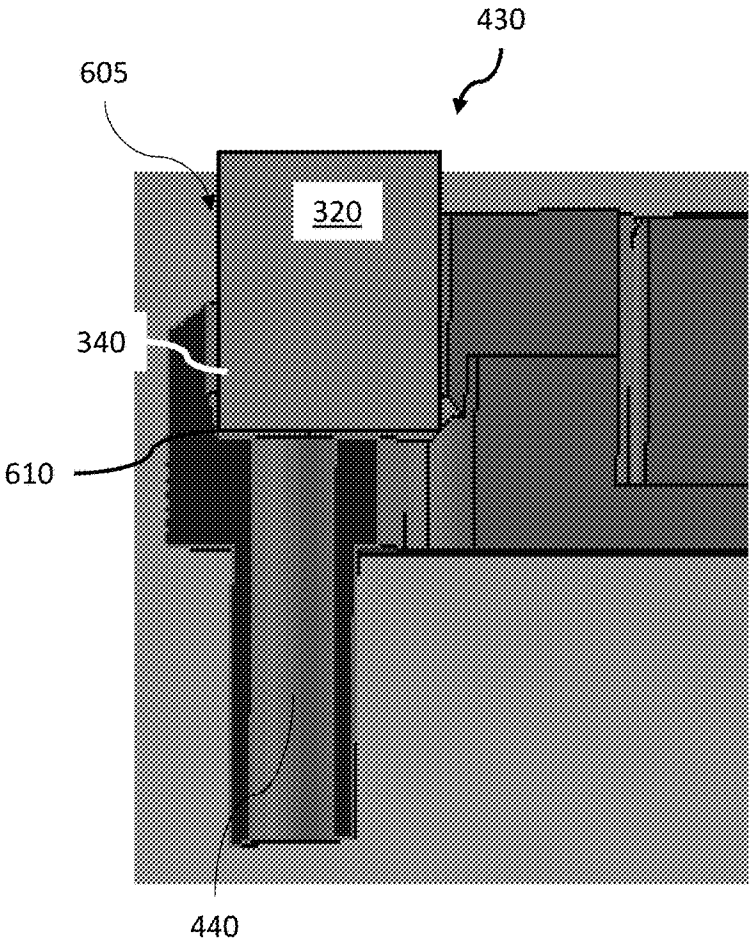
FIG. 6C shows a schematic diagram of a rear recoil lug inserted in the rear recoil lug receptacle.

FIG. 6C shows a schematic diagram of the rear recoil lug 320 inserted in the rear recoil lug receptacle 430. According to at least one embodiment, the rear recoil lug 320 may be drawn into the rear recoil lug receptacle 430 by a fastener inserted into through hole 440. As the rear recoil lug 320 is inserted into the rear recoil lug receptacle 430, the rear recoil lug rearward facing truncated ovoid or cylindrical shape 340 is forced vertically downward and slidingly contacts the chamfer 610 forcing the rear recoil lug 320 to be centered in the bore 605, thus centering the rear recoil lug 320 and at least the rearward portion 360 of the receiver frame 305 in the bedding block 130 between the longitudinally extending sides 405, 410. The rear recoil lug 320 may be drawn tightly into the rear recoil lug receptacle 430 such that contact between the rear recoil lug rearward facing truncated ovoid or cylindrical shape 340 and the chamfer 610 provides vertical, horizontal, and torsional rigidity, and longitudinal rigidity at least in the rearward direction.

In some embodiments, the difference in material of the receiver frame 305 and the bedding block 103 and the configuration of the bedding block 103 may lead to an increased close fit between the receiver frame 305 and the bedding block 103 as the receiver frame 305 and the bedding block 103 are subjected to firing forces. As the receiver frame 305 and the bedding block 103 are subjected to firing forces, the less rigid material of the bedding block may conform to the surfaces of the receiver frame, resulting in further vertical, horizontal, torsional, and longitudinal rigidity between the receiver frame 305 and the bedding block 103.

It is noted that the embodiments described herein can be used individually or in any combination thereof. It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Various features of the different embodiments described herein are interchangeable, one with the other. The various described features, as well as any known equivalents can be mixed and matched to construct additional embodiments and techniques in accordance with the principles of this disclosure.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. A bedding block configured to be attached to a receiver frame and fastened to a firearm stock, comprising:

a front recoil lug receptacle comprising:

a forward cam surface having laterally extending stepped ribs with bottom ribs of the laterally extending stepped ribs extending further into the front recoil receptacle than upper ribs of the laterally extending stepped ribs;

a rearward bearing surface; and a first opening for a first fastener for attaching the receiver frame to the bedding block; and a rear recoil lug receptacle having a truncated ovoid bore and a second opening for a second fastener for attaching the receiver frame to the bedding block.

2. The bedding block of claim 1, wherein the laterally extending stepped ribs are arranged to contact a forward facing cam surface of a recoil lug and force a rearward facing surface of the recoil lug into bearing contact with the rearward bearing surface of the front recoil lug receptacle.

3. The bedding block of claim 1, wherein the laterally extending stepped ribs comprise center portions and distal ends extending rearward from the center portions.

4. The bedding block of claim 1, further comprising longitudinally extending sides within which the center portions of the laterally extending stepped ribs are centered.

5. The bedding block of claim 4, wherein the laterally extending stepped ribs are arranged to force a recoil lug inserted into the front recoil lug receptacle toward the center portions of the of the laterally extending stepped ribs, centering the recoil lug between the longitudinally extending sides.

6. The bedding block of claim 1, wherein the rear recoil lug receptacle further comprises a narrowing chamfer to which the truncated ovoid bore vertically extends.

7. The bedding block of claim 6, further comprising longitudinally extending sides within which the rear recoil lug receptacle is centered.

8. The bedding block of claim 7, wherein the narrowing chamfer is arranged to force a recoil lug inserted into the rear recoil lug receptacle to be centered in the truncated ovoid bore, centering the recoil lug between the longitudinally extending sides.

* * * * *